United States Patent [19]

Wilson et al.

[11] Patent Number: 4,466,481

[45] Date of Patent: Aug. 21, 1984

[54] LEAK DETECTING MATRIX FOR HEAT EXCHANGES

[75] Inventors: John E. Wilson, Liberty Corner; John Polcer, Brookside, both of N.J.

[73] Assignee: Foster Wheeler Energy Corporation, Livingston, N.J.

[21] Appl. No.: 352,488

[22] Filed: Feb. 25, 1982

[51] Int. Cl.[3] ..... F28F 11/00

[52] U.S. Cl. ..... 165/70; 165/11 R; 165/76

[58] Field of Search ..... 165/70, 76, 11

[56] References Cited

U.S. PATENT DOCUMENTS

| | | | |
|---|---|---|---|
| 4,182,408 | 1/1980 | Laber | 165/70 |
| 4,192,373 | 3/1980 | Wolowodiuk | 165/70 |
| 4,249,413 | 2/1981 | Denis | 165/11 R |

*Primary Examiner*—William R. Cline
*Assistant Examiner*—John F. McNally
*Attorney, Agent, or Firm*—Marvin A. Naigur; Thomas L. Adams

[57] ABSTRACT

A heat exchanger for exchanging the heat between separate fluids has a plurality of heat exchange tubes. These tubes are alternatively divisible into a primary plurality and into an alternative plurality of mutually exclusive subsets. Each one of the primary subsets shares in common with any one of the alternative subsets, one of the tubes. The heat exchanger also has first and second tube sheets each having a plurality of tube holes. Each of the heat exchange tubes are mounted between the first and second tube sheets. Each end of each tube is sealed into a corresponding one of the tube holes. The first and second tube sheets each have a plurality of internal, isolated passageways. Each of these passageways in the first and second tube sheets communicate with the surfaces of the tubes in a different associated one of the primary and alternative subsets, respectively. By monitoring at both tube sheets the combined leakage from each of the plurality of subsets of tubes, a leak can be isolated to that tube which is common to those subsets leaking at the pair of tube sheets. This isolation is readily obtained since the subsets monitored at each of the tube sheets are organized differently but from the same tubes.

14 Claims, 10 Drawing Figures

LEAK DETECTING MATRIX FOR HEAT EXCHANGES

BACKGROUND OF THE INVENTION

The present invention relates to heat exchangers and, in particular, to systems and techniques for determining the location of a leak among a plurality of heat exchange tubes.

There are many applications where leakage into or through tubes must be avoided or detected immediately. One example is the heat exchanger in a nuclear power plant where water within the tubes is heated by liquid sodium. Another example is where sodium heated in a nuclear reactor is used to heat sodium within the tubes which in turn is used to heat water in another heat exchanger. Such a double sodium loop makes leakage of radioactive sodium into the water unlikely. Such leakage must be avoided since the mixing of water and sodium could result in a sodium-water explosion that could scatter radioactive materials under high heat and pressure. Thus, the early detection of leakage is very important for these and other applications.

In a known heat exchanger, (U.S. Pat. No. 4,192,373) a tube sheet employs many rows of tube holes. This known heat exchanger has duplex heat exchange tubes sealed to its tube holes so that leaks in the tubes migrate through the space between the inner and outer wall of the duplex tube to tube holes. A lateral bore extending between rows of these tube holes has a branch channel communicating with the tube holes on either side of the lateral bore. In this way a leak could be isolated to a group of tubes. Moreover, because the junctures between the lateral bore and tube holes are evenly spaced along the lateral bore, a leak detector inserted through the bore can isolate a leak to one particular tube hole.

It is also known to employ a grid of leak detecting pipes in a pile of moderating material in an atomic reactor. The pipes are arranged in a rectangular grid at the face of the material with its intersections near the drainage ducts of the pile. The leak detecting pipes are arranged one for each horizontal row and for each vertical column of drainage ducts. Each leak detecting pipe samples the combined leakage from its associated row or column of drainage ducts. Accordingly, the leak detecting pipes can determine the coordinates of a leak by determining its row and column. However, this type of leak detecting system does not consider how leaks can be detected in a heat exchanger employing heat exchange tubes and tube sheets.

Accordingly, there is a need for a leak detection system which can quickly and simply identify which one of a plurality of heat exchange tubes in a heat exchanger is leaking.

SUMMARY OF THE INVENTION

In accordance with the illustrative embodiments demonstrating features and advantages of the present invention there is provided a heat exchanger for exchanging heat between separated fluids. The heat exchanger includes a plurality of heat exchange tubes and first and second tube sheets. The heat exchange tubes are alternatively divisible into a primary plurality and into an alternative plurality of mutually exclusive subsets. Each of the primary subsets share in common with any one of the alternative subsets, one of the tubes. The first and second tube sheets each have a plurality of tube holes. Each of the heat exchange tubes is mounted between the first and second tube sheets. Each end of each of the tubes is sealed into a corresponding one of the tube holes. The first and second tube sheets each have a plurality of internal, isolated passageways. Each of the passageways in the first and second tube sheets communicate with the surfaces of the tubes in a different associated one of the primary and alternative subsets, respectively.

In a related method according to the principles of the same invention, a leak in a plurality of heat exchange tubes can be isolated. These tubes are mounted between a pair of tube sheets in a heat exchanger. The method includes the step of monitoring the combined leakage from each of a plurality of subsets in said tubes. The subsets monitored at each of the tube sheets is organized differently from the same tubes. The method also includes isolating a leak to that tube which is common to those subsets that are leaking at the pair of tube sheets.

By employing such apparatus and such methods, simple and efficient leak detection is provided. Preferably, the tube sheets have spaced parallel bores communicating with corresponding rows of tube holes. In one embodiment, the tube sheets at either end are constructed identically but have a different angular orientation with respect to the axis of the heat exchanger. In this embodiment, the tube sheets are displaced 90° from each other and the lateral bores communicating with the tube holes are at right angles to the heat exchange tubes.

Preferably, each heat exchange tube is a duplex tube having its outer wall sealed to the inside surface of a tube sheet and its inner wall sealed to the outside surface of that tube sheet. This allows fluid in between the inner and outer walls to migrate into the tube hole so that the lateral bores communicating therewith can drain the leaking fluid.

In one embodiment, the passageways communicate with various rows and columns of tubes and lead to separate fluid detectors. Preferably, there is one fluid detector for each passageway. Thus, it is possible to determine the coordinates of a leaking tube by observing which row and which column of tubes has triggered leak detectors. The determination of the row and column of the leak determines the specific coordinates of the leaking tube.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings wherein.

DETAILED DESCRIPTION OF THE PREFERRED EMBODIMENTS

Figure 1:
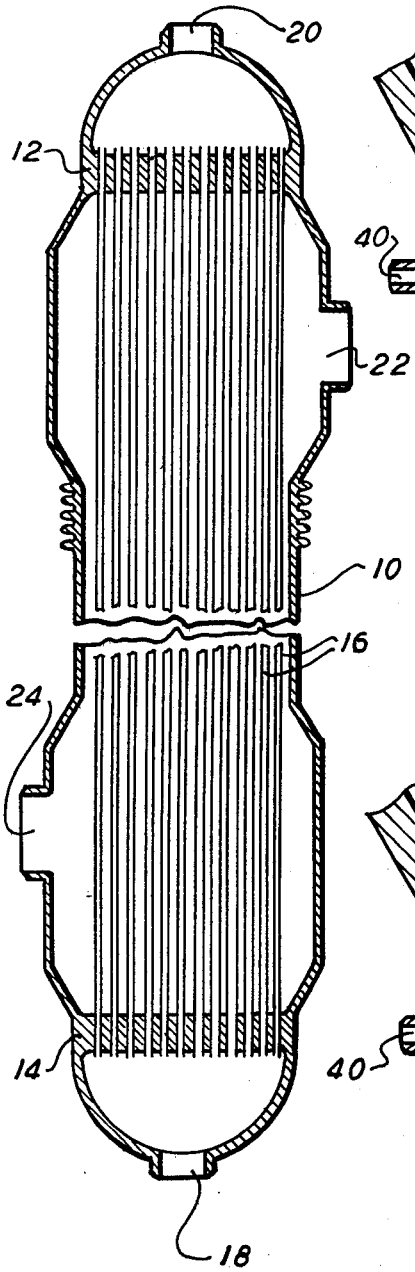
FIG. 1 is a sectional view of a heat exchanger employing tubes and tube sheets according to the principles of the present invention.

In FIG. 1 a heat exchanger is shown herein as a generally cylindrical shell 10 encircling near its opposite ends, first tube sheet 12 and second tube sheet 14. As further described hereinafter, tube sheets 12 and 14 are circular plates pierced normally by a plurality of tube holes. Sealed and mounted in these tube holes between tube sheets 12 and 14 are a plurality of heat exchange tubes 16. Heat exchange tubes 16 allow fluid such as water to pass between inlet 18 and outlet 20 without entering into the main body of shell 10 outside of the tubes. A heating fluid such as liquid sodium can enter the main shell 10 of the heat exchanger at inlet 22, leaving at outlet 24. The opportunity for heat to be exchanged between the fluids within and without heat exchange tubes 16 is considerable and depends upon the length of the tubes, the thickness of their walls, the temperature difference, etc.

Figure 2:
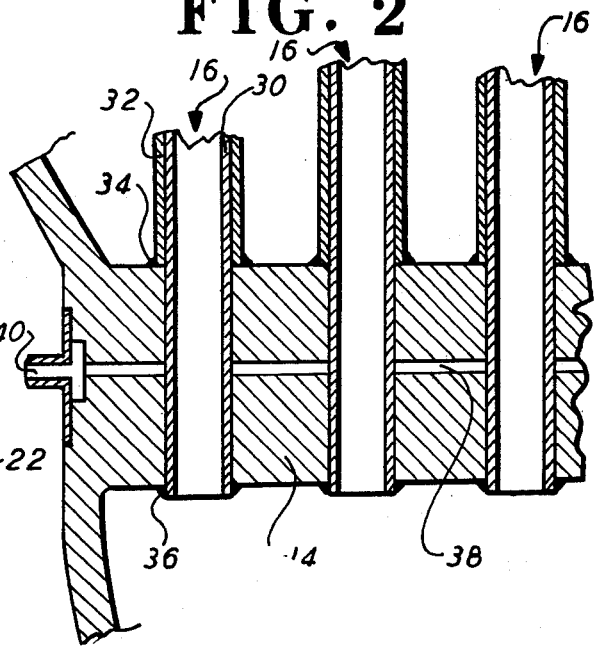
FIG. 2 is a detailed view of a portion of the heat exchanger of FIG. 1.

Referring to FIG. 2, each of the heat exchange tubes 16 is shown as a pair of coaxial conduits: inner conduit 30 and outer conduit 32. The illustrated end of outer conduit 32 is shown welded to the inside surface of tube sheet 14 at annular weld 34. The illustrated end of inner conduit 30 is shown welded to the outside surface of tube sheet 14 at annular weld 36. The row of duplex tubes 16 illustrated in FIG. 2 fits into a corresponding row of tube holes. These tube holes intersect a passageway shown herein as lateral bore 38. Bore 38, connected on one end with flanged fitting 40, communicates with the outer surface of conduit 30 and, therefore, the inner surface of conduit 32.

Figure 3:
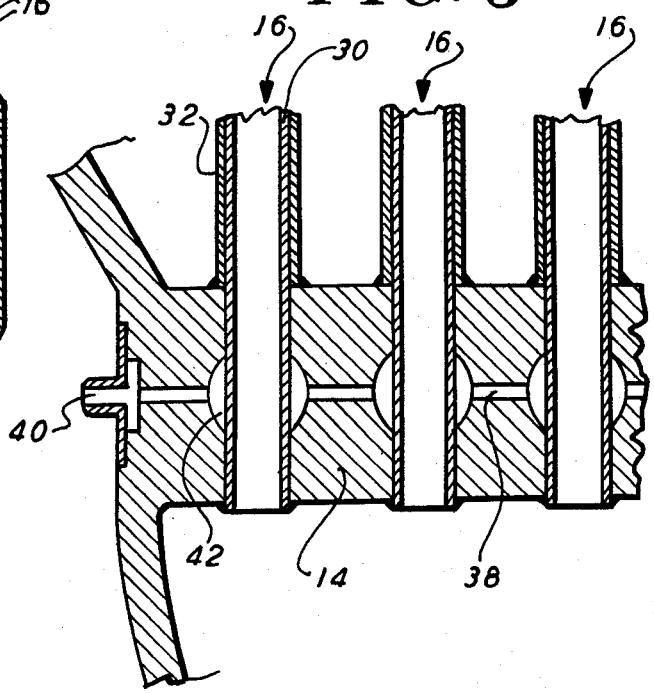
FIG. 3 is a detailed view showing an embodiment which is an alternate to that of FIG. 2.

Referring to FIG. 3, tube sheet 14 is shown modified so that lateral bore 38 is flared into a spherical cavity 42 at its point of intersection with tubes 16. Thus, an annular space 42 is provided around conduits 30.

Figure 4:
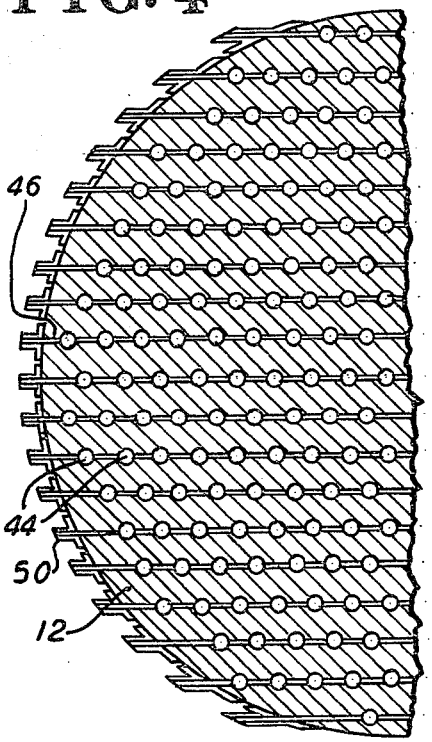
FIG. 4 is a sectional, partial, plan view of the upper tube sheet in the heat exchanger of FIG. 1.

A plan view is given in FIG. 4 of the tube holes 44 in tube sheet 12. The tube holes 44 are arranged in a regularly repeating rhombic pattern, one tube hole at each of the four corners. In tube sheet 12, the rows (horizontal in this view) of tube holes are connected by individual parallel passageways 46, which lead to corresponding fittings 50. It will be appreciated that fittings 50 are only needed on one end of passageways 46 and these passageways may be blind (closed on non-fitting end).

Figure 5:
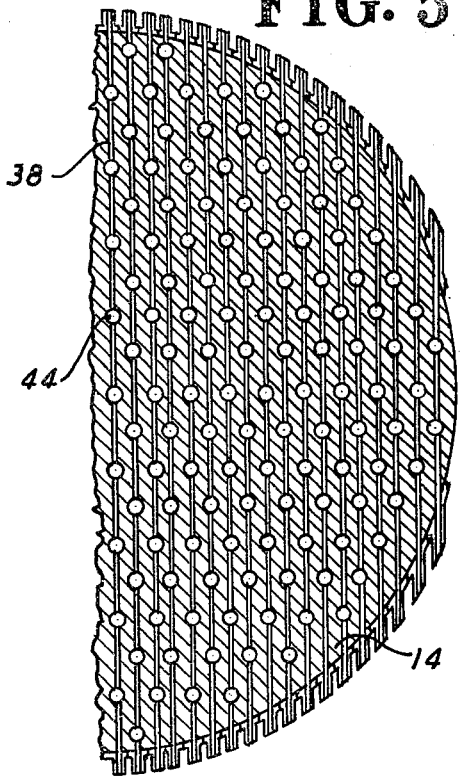
FIG. 5 is a sectional, partial, plan view of the lower tube sheet in the heat exchanger of FIG. 1.

Referring to FIG. 5, the previously illustrated lower tube sheet 14 is shown having a different construction. It will be understood that tubes 16 (FIG. 1) extend between matching tube holes so the tubes are parallel. While tube holes 44 have a pattern identical to that previously illustrated in FIG. 4, passageways 38 extend differently and form closely spaced parallel columns (vertical in this view). By comparing FIGS. 4 and 5, it will be appreciated that passageways 38 (FIG. 5) intersect the tubes in tube holes 44 in a direction which is orthogonal to passageways 46 (FIG. 4). It will also be appreciated that each tube can be uniquely defined by the particular row (passageways 46) and column (passageways 38) intersecting that tube.

Figure 6:
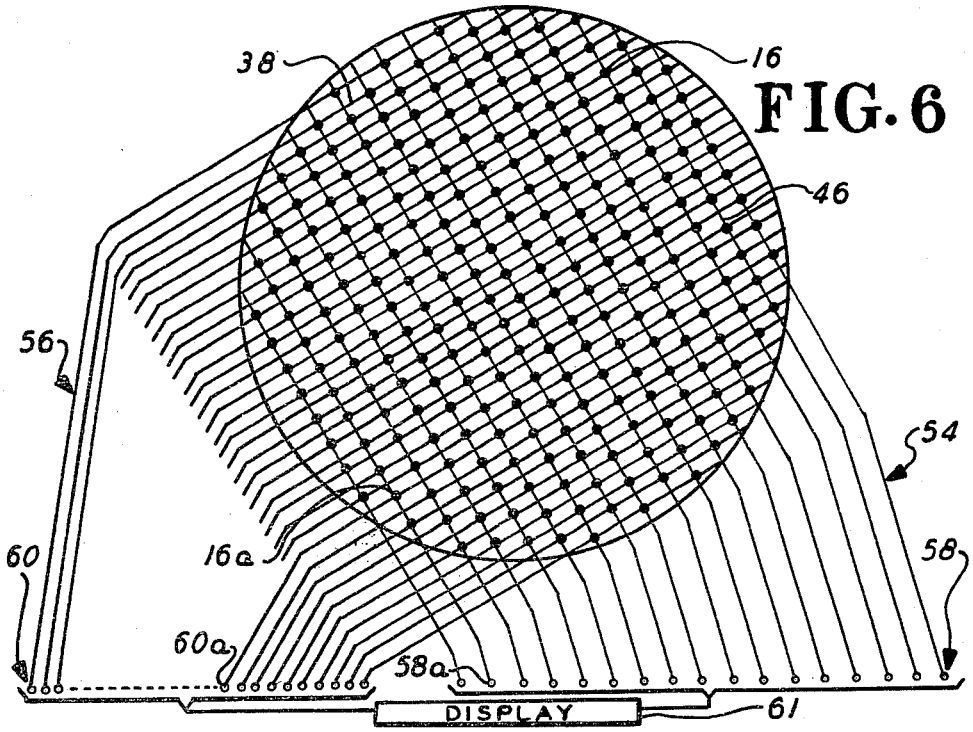
FIG. 6 is a schematic diagram showing the use of fluid detection means with the heat exchanger of FIG. 1.

Referring to FIG. 6, a schematic diagram shows the overlapping and intersecting of rows and columns of passageways 38 and 46. The tubes intersecting passageways 38 and 46 are herein referred to as a primary and alternative plurality, respectively, of subsets of tubes 16. It will be readily observed that a coordinate system is thus illustrated wherein the intersection of a pair of orthogonal passageways uniquely defines a specific one of the tubes 16. The rows of passageways 46 are shown feeding lines 54, while the columns of passageways 38 feed lines 56. Lines 54 and 56 are shown feeding a plurality of fluid detection means 58 and 60, respectively. These fluid detectors 58 and 60 may be any suitable sensors that can detect the presence of either of the fluids which may be contained in the heat exchanger of FIG. 1. For example, a masspectrometer may be employed or a pair of electrodes separated by a fluid-degradable compound (for example, $CaCl_2$ which is degradable in the presence of water). Accordingly, an electrical signal can be produced when leakage reaches detectors 58 and 60. The outputs of fluid detectors 58 and 60 are shown providing inputs to a display panel 61 which can employ a diode matrix or other suitable circuitry for lighting a common failure light or that one of a plurality of a failure lights indicating the leaking tube. Alternatively, the signals from detectors 58 and 60 may drive a computer to display the location of the leaking tube on a cathode ray tube.

Figure 7A:
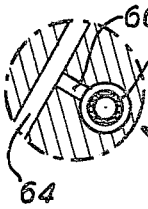
FIGS. 7 and 7A are sectional, plan views of a tube sheet which is an alternate to that of FIG. 4.
Figure 7:
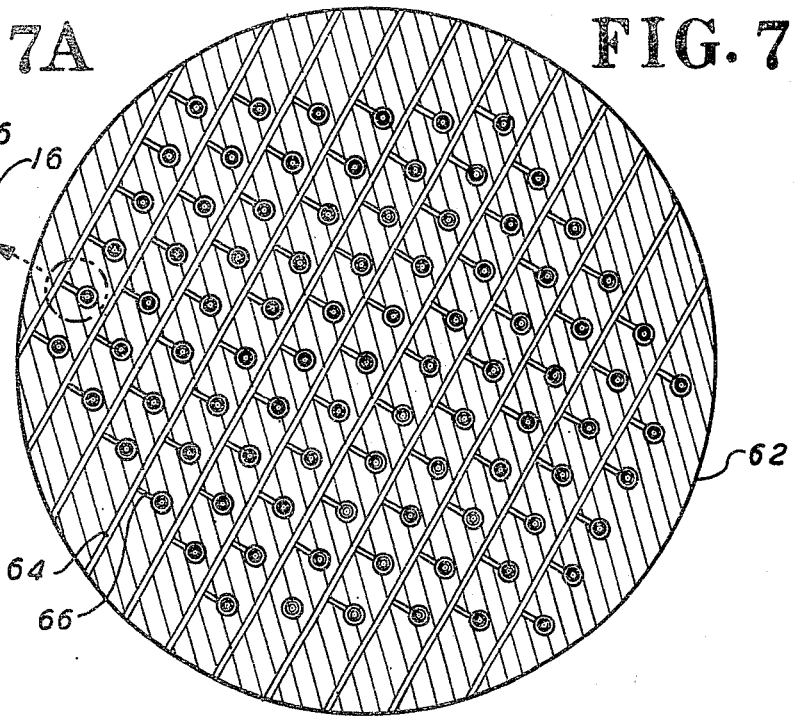

Referring to FIG. 7, alternate tube sheet 62 is illustrated having a plurality of rows (illustrated horizontal) of the tubes holes and columns of tube holes oriented at 60 degrees thereto. Tubes 16 are shown concentrically located within the tube holes. A plurality of parallel lateral bores 64 are shown running parallel to and alongside each of the slanted columns of tube holes. Lateral bores 64 communicate on one side with each adjacent tube hole by means of transverse orifices 66. In this embodiment, the opposite tube sheets in the heat exchanger are both constructed as shown in FIG. 7. However, one is rotated 60 degrees with respect to the other. Consequently, a coordinate system not unlike that of FIG. 6 is generated with horizontal rows and columns at 60 degrees to these rows. This dual use of the same tube sheet is facilitated by the fact that the pattern of tube holes in tube sheet 62 remains the same when rotated by 60 degree increments.

Figure 8:
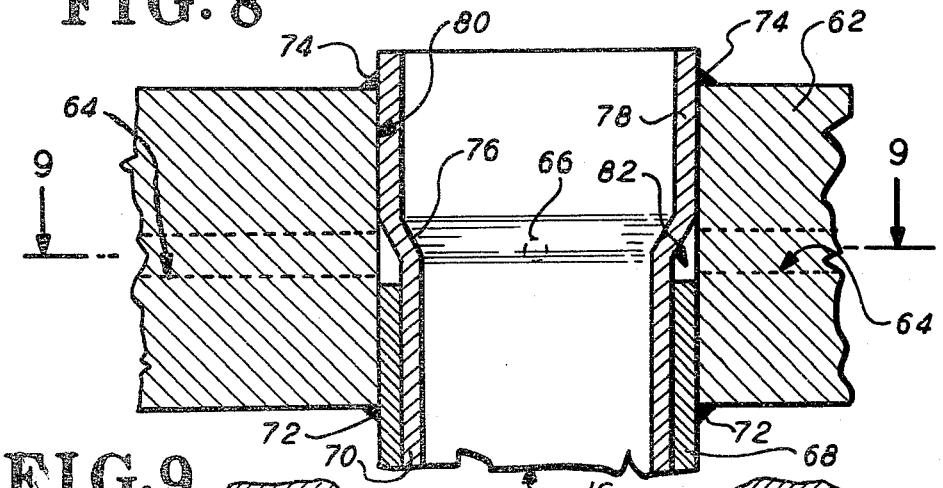
FIG. 8 is a detailed sectional view along lines 8—8 of FIG. 7.

Referring to FIG. 8, outer wall 68 of duplex tube 16 does not extend entirely through tube sheet 62. Inner wall 70 of duplex tube 16 does extend through to the opposite side of the tube sheet. Outer wall 68 is welded at bead 72 to the side of the tube sheet which contacts the fluid which does not flow within duplex tubes 16. The inner wall 70 is welded at bead 74 to the opposite side of tube sheet 62. Inner wall 70 is flared outwardly at bend 76 so that end portion 78 of inner wall 70 engages the inside of tube hole 80. End portion 78 may have the same diameter as outer tube 68 so that both the outer tube 68 at its end and the inner tube 70 at its end portion 78 engage against tube hole 80.

Annular collection space 82 is bounded by inner wall 70 and the butt of outer wall 68 and tube sheet 62, so that chamber 82 is entirely within the tube hole 80. If there is leakage either through the wall 70 or 68, the leaking fluid will migrate between walls 70 and 68 and reach the annular collection chamber 82. Annular collection chamber 82 connects to one of the orifices 66 and communicates through that orifice with one of the lateral bores 64.

Figure 9:
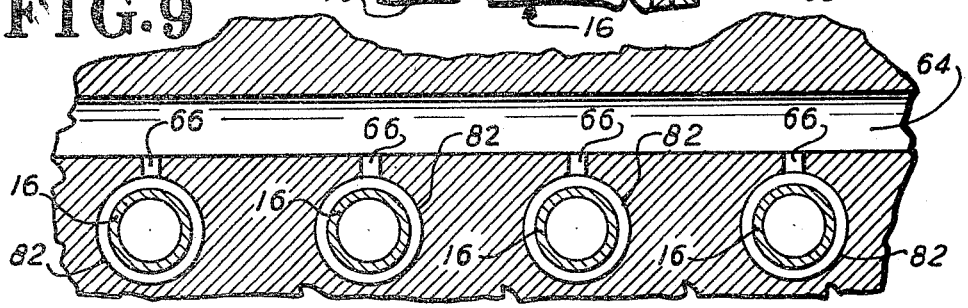
FIG. 9 is a sectional view along lines 9—9 of FIG. 8.

FIG. 9 shows bore 64 communicating through its orifices 66 with one of the collection chambers 82. If any of the duplex heat exchange tubes 16 should fail, leaking fluid collected in annular collection chamber 82 associated with the particular duplex tube, would flow through an associated orifice to bore 64.

To facilitate an understanding of the principles associated with the foregoing, the operation of the apparatus shown in FIGS. 1, 3, 4, 5 and 6 will be described initially. It will be appreciated that the embodiment of FIG. 2 operates in an equivalent fashion except that it does not have an annular space surrounding the tubes to collect leakage. In operation, duplex tubes 16 (FIG. 3) can leak through either their outer wall 32 or inner wall 30. Leakage through either of these walls will cause migration of fluid between walls 30 and 32 into annular space 42 within tube sheet 14 or tube sheet 12. Accordingly, the leakage will eventually reach fitting 40. As shown in FIG. 6, leakage of a particular tube, for example, tube 16*a* will cause leakage to reach fluid detectors 60*a* and 58*a*. Dual detection by the latter two devices specifies the coordinates of the leaking tube. In a situation where $CaCl_2$ insulating a pair of electrodes in the detectors breaks down in response to such leakage, an electrical signal is generated from detectors 58*a* and 60*a* which are conveyed to display 61. Display 61 in this embodiment has a plurality of indicating lights arranged spatially to simulate the pattern of tubes being monitored. Accordingly, the diode matrix of display 60 energizes a particular indicator (not shown) indicating which one of the many tubes has leaked.

The apparatus of FIGS. 7, 8 and 9 operates similarly since, as previously described, leakage from subsets of tubes is collected in passageways 64. Passageways 64 are again arranged in a coordinate system for isolating leaks to one (horizontal) row at one end and one (slanted) column at the other end of the tubes 16. In a similar fashion, passageways 64 can drive detectors and displays as shown in FIG. 6.

It is to be appreciated that various modifications may be implemented with respect to the above described preferred embodiments. For example, while leak detecting passageways are shown arranged in straight rows and columns that are either orthogonal or diagonal, other arrangements are possible. The various arrangements should act as a coordinate system so individual tubes or groups of tubes can be isolated. For example, polar coordinates could be used wherein one pattern of leak-detecting passageways can be a group of concentric circles while the other is a series of separated, radial passageways. In addition, while the tubes shown herein have circular cross sections, other shapes can be used in alternate embodiments. Furthermore, it is to be appreciated that the tubes need not be parallel and, therefore, non-matching tube hole patterns are possible. Furthermore, while spherical and annular cavities are shown for collecting leakage from the tubes, various other shapes can be employed depending upon the application. Moreover, while automatic sensing and display of leak location is described herein, it will be appreciated that a single fluid detector can be manually moved from one passageway to the other to ascertain the location of a leak. In addition, the fluid detector can be sensitive to whether leakage is of the type of fluid within or without the duplex tube to determine whether the inner or outer wall has been breached. Also in some embodiments, the fluid detection may be performed visually. Furthermore, the materials and dimensions disclosed herein can be altered depending upon the desired fluid flow rate, thermal transfer rate, maximum temperature, mechanical rigidity, immunity to vibration, resistance to corrosion, available space, etc.

Obviously, many modifications and variations of the present invention are possible in light of the above teachings. It is therefore to be understood that within the scope of the appended claims, the invention may be practiced otherwise than as specifically described.

What is claimed is:

1. A heat exchanger for exchanging heat between separated fluids, comprising:

a plurality of heat exchange tubes, said tubes being alternatively divisible into a primary plurality of mutually exclusive subsets and into an alternative plurality of mutually exclusive subsets, each one of said primary subsets sharing in common with any one of said alernative subsets at least one of said tubes; and first and second tube sheets each having a plurality of tube holes, each of said heat exchange tubes being mounted between said first and second tube sheets, each end of each of said tubes being sealed into a corresponding one of said tube holes, said first and second tube sheets each having a plurality of internal, isolated passageways, each of said passageways in said first tube sheet communicating with the surfaces of the tubes in a different associated one of said primary subsets, each of said passageways in said second tube sheet communicating with the surfaces of the tubes in a different associated one of said alternative subsets, so that said isolated passageways of said first tube sheet form a coordinate reference with said passageways of said second tube sheet for locating a leak.

2. A heat exchanger according to claim 2 wherein each of said tubes is intersected at each end by one of said passageways at a different angle to the axis of the tube.

3. A heat exchanger according to claim 2 wherein each of said tubes intersects only two of said passageways.

4. A heat exchanger according to claim 2 wherein said tubes are parallel and within each of said tube sheets said passageways are parallel, the passageways of said first tube sheet being skewed with respect to those of said second tube sheet.

5. A heat exchanger according to claim 4 wherein each of said tubes comprise a pair of coaxial conduits, the inner one extending beyond the ends of the outer one and intersecting said passageways.

6. A heat exchanger according to claim 5 wherein said pair of conduits are sealed to said tube sheets to allow intersecting ones of said passageways to communicate with the interspace between said conduits.

7. A heat exchanger according to claim 1 further comprising:

a detection means for detecting fluid in said passageways.

8. A heat exchanger according to claim 7 wherein each of said tubes intersects a unique pair of said passageways, said detection means comprising:

a plurality of fluid detectors which are at least as numerous as the passageways in said first tube sheet.

9. A heat exchanger according to claim 8 wherein each of said fluid detectors are coupled to a unique one of said passageways in said first and second tube sheets.

10. A heat exchanger according to claim 1 wherein said first and second tube sheets are spaced, parallel, coaxial and identical, said tube sheets having a different angular orientation to their common axis.

11. A heat exchanger according to claim 10 wherein said passageways comprise a lateral bore intersecting associated ones of said tube holes.

12. A heat exchanger according to claim 10 wherein said passageways are larger at their intersection with the tube holes to provide an annular space around said tubes.

13. A heat exchanger according to claim 10 wherein said passageways comprise a lateral bore passing alongside associated ones of said tube holes, a transverse orifice spanning each of said associated ones of said tube holes and said lateral bore.

14. A method for isolating a leak in a plurality of heat exchange tubes mounted between a pair of tube sheets in a heat exchanger, comprising the steps of:

monitoring at said pair of tube sheets the combined leakage from each of a plurality of subsets of said tubes, the subsets monitored at each of the tube sheets being organized differently from the same tubes to form a coordinate system; and isolating a leak to that tube which is common to those subsets found to be leaking at both of the pair of tube sheets.

* * * * *